US005636487A

United States Patent [19]

Fligg

[11] Patent Number: 5,636,487

[45] Date of Patent: Jun. 10, 1997

[54] INSULATION SUPPORTING STRIP AND HOLDING BRACKET FOR RECEIVING IT

[76] Inventor: Robert E. Fligg, 2501 Jordan Grove, West Des Moines, Iowa 50266

[21] Appl. No.: 604,077

[22] Filed: Feb. 20, 1996

Related U.S. Application Data

[63] Continuation-in-part of Ser. No. 394,905, Feb. 27, 1995, Pat. No. 5,535,560, and Ser. No. 134,597, Oct. 12, 1993, Pat. No. 5,442,890.

[51] Int. Cl.[6] ..... E04B 1/74

[52] U.S. Cl. ..... 52/404.5; 52/404.3

[58] Field of Search ..... 52/404.3, 404.5, 52/743, 468, 90.1

[56] References Cited

U.S. PATENT DOCUMENTS

| | | | |
|---|---|---|---|
| 4,117,641 | 10/1978 | Wells | 52/404.3 |
| 4,425,747 | 1/1984 | Player | 52/404.3 |
| 4,434,601 | 3/1984 | Zellmer . | |
| 4,586,301 | 5/1986 | Hickman . | |
| 4,694,543 | 9/1987 | Conley . | |
| 4,724,651 | 2/1988 | Fligg . | |
| 4,817,655 | 4/1989 | Brooks . | |
| 5,209,029 | 5/1993 | Foerst . | |
| 5,442,890 | 8/1995 | Fligg . | |

*Primary Examiner*—Carl D. Friedman
*Assistant Examiner*—Beth A. Aubrey
*Attorney, Agent, or Firm*—Henderson & Sturm

[57] ABSTRACT

A method of installing insulation under a pre-existing roof of a building of a type having a spaced apart structural beams standing in one direction under the roof and a plurality of spaced apart elongated purlins extending transversely to the structural beams and being supported by the structural beams. Purlin clips are used which connect to the purlins at the top and to a lower support member at the bottom thereof. The method includes installing an upper support member across from one to the other of an adjacent pair of purlins. An upper strip of insulation is positioned between adjacent pairs of purlins above the upper support member whereby the strip of insulation will be supported by the upper support member. A lower strip of insulation is attached at one end into one of the structural beams, under the upper layer of insulation, and to the other of the structural beams at the other end thereof. A lower support member is then attached between adjacent purlin clips and under the lower strip of insulation for supporting the under side of the lower strip of insulation. The upper support member or members are then removed so that the upper strip of insulation will move down and be supported on top of the lower strip of insulation.

6 Claims, 6 Drawing Sheets

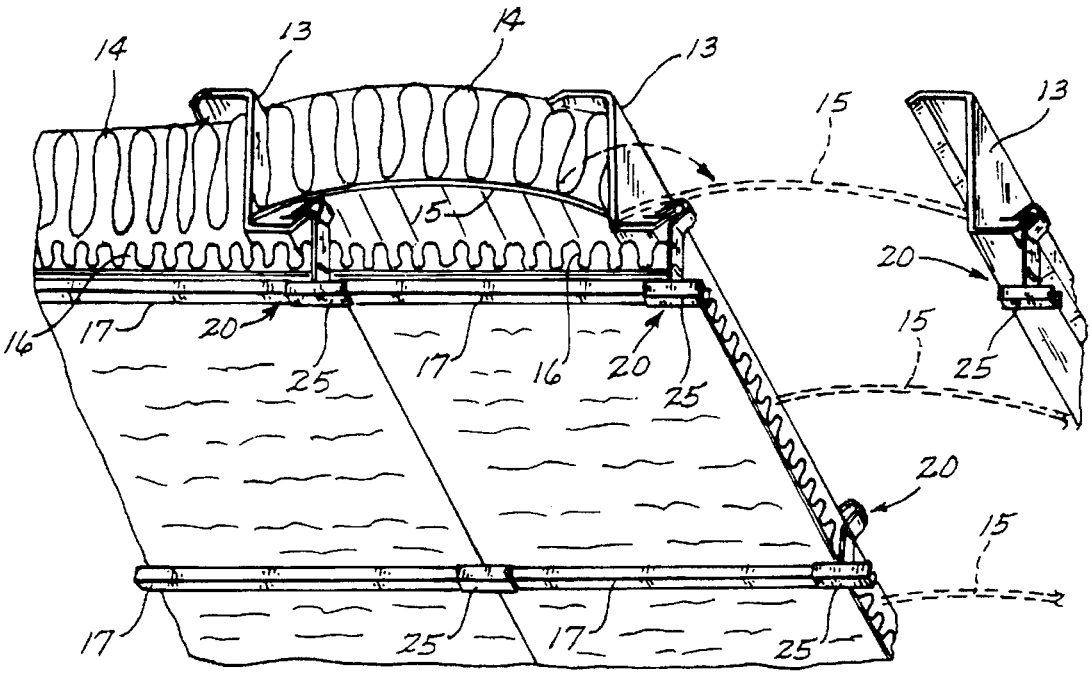
Fig. 8
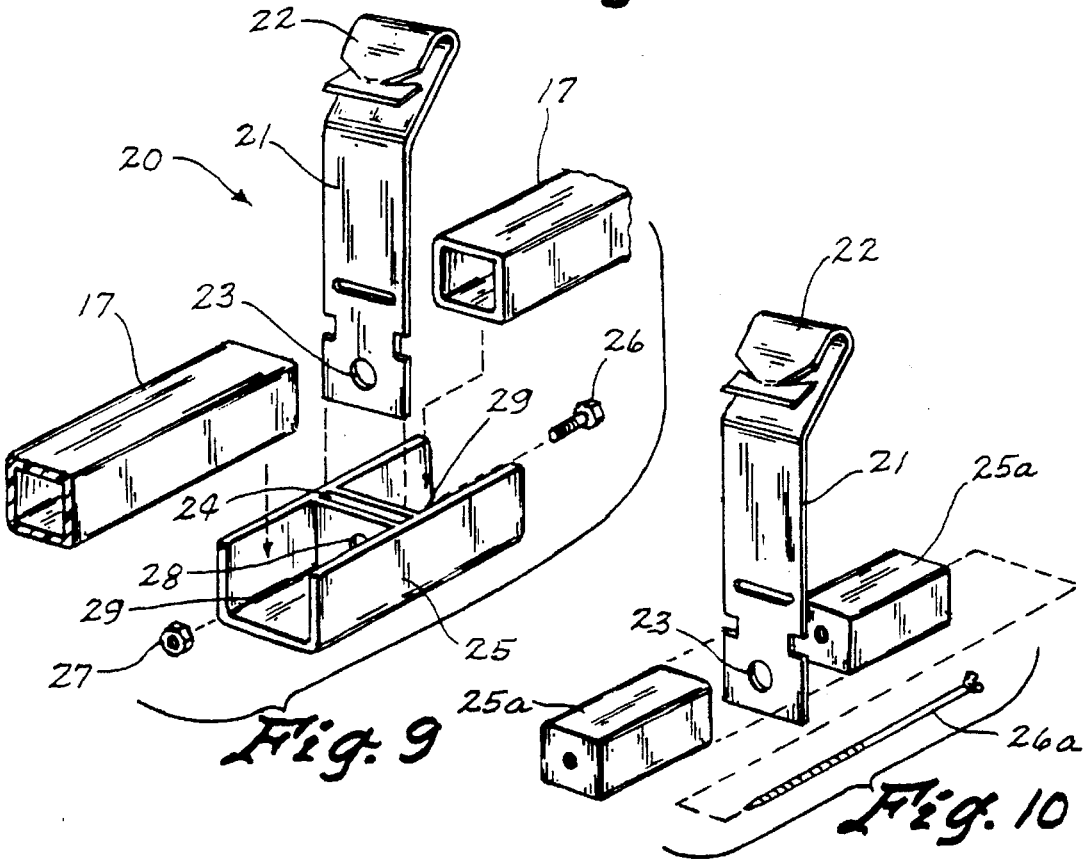
Fig. 9
Fig. 10

INSULATION SUPPORTING STRIP AND HOLDING BRACKET FOR RECEIVING IT

This is continuation-in-part of application Ser. No. 08/394,905, filed on Feb. 27, 1995, entitled CONNECTING APPARATUS FOR USE IN INSTALLING INSULATION IN BUILDINGS, now U.S. Pat. No. 5,535,560issued Jul. 16, 1996 and Ser. No. 08/134,597, filed on Oct. 12, 1993 entitled INSTALLING INSULATION IN BUILDINGS, now U.S. Pat. No. 5,442,890 issued Aug. 22, 1995.

TECHNICAL FIELD

The present invention relates generally to a method and apparatus for installing insulation into the top of a building, and more particularly to such method which installs strips of fiberglass insulation into a building which already has the roof thereof installed.

BACKGROUND ART

It is, of course, well known that buildings must be insulated in order to retain heat or cold when the temperatures outside are very different from the desired temperature within the building. This is particularly a problem in metal buildings of a commercial type, since metal is a very good conductor of heat.

In order to install insulation in the ceiling of a metal building, it has become a common practice to insulate during the initial construction of the building and to provide the insulation in the top of the building before the final layer of the roof is put onto the building, for example, as shown in U.S. Pat. No. 4,346,543 to Wilson et al. One of the problems with this approach is that the installation of the insulation interferes with the construction of the building. Usually, different people do the insulation work, and since the speed of installing the building is typically very important, the insulation steps detract from the timeliness of construction. Consequently, there is a need to be able to insulate a building more quickly.

Another category of insulation problems relates to insulating a building which is already existing, or adding insulation to such existing building in order to increase the R-factor of the ceiling or walls. Especially since each existing building is somewhat different, there is no one approach that seems to be universally acceptable.

U.S. Pat. No. 4,724,651 to Fligg dealt with a similar problem, but the problem was solved by blowing loose insulation into the space between the purlins above a lower fiberglass matt. While there has been a desire by the inventor herein to replace the blown-in loose fiberglass material with a fiberglass matt, the problem has been a perplexing one until this present invention was developed.

DISCLOSURE OF THE INVENTION

The present invention relates to a method of installing insulation under a pre-existing roof of a building of a type having a spaced apart structural beams extending in one direction under the roof and a plurality of spaced apart elongated purlins extending transversely to the structural beams and being supported by the structural beams. Purlin clips are used which connect to the purlins at the top and to a lower support member at the bottom thereof.

The method includes installing an upper support member across from one to the other of an adjacent pair of purlins. An upper strip of insulation is positioned between adjacent pairs of purlins above the upper support member whereby the strip of insulation will be supported by the upper support member. A lower strip of insulation is attached at one end into one of the structural beams, under the upper layer of insulation, and to the other of the structural beams at the other end thereof. A lower support member is then attached between adjacent purlin clips and under the lower strip of insulation for supporting the under side of the lower strip of insulation. The upper support member or members are then removed so that the upper strip of insulation will move down, by gravity, and be supported on top of the lower strip of insulation.

Another aspect of the invention relates to the apparatus for attaching the ends of the lower strip of insulation to the structural beams and still another aspect of the invention relates to the apparatus for attaching the lower support members to the lower end of the purlin clips.

An object of the present invention is to provide an improved an apparatus for installing insulation in a building which already has the roof thereon.

A further object of the present invention is to provide an apparatus for attaching the lower end of a purlin clip to a structural member which is provided between purlins to hold up the fiberglass mats being installed.

Other objects, advantages, and novel features of the present invention will become apparent from the following detailed description of the invention when considered in conjunction with the accompanying drawings.

BRIEF DESCRIPTION OF THE DRAWINGS

FIG. 8 is a perspective view of the structure referred to above in the process of installing the two layers of insulation;

FIG. 9 is an enlarged perspective view of a purlin clip and its associated lower support members;

FIG. 10 is an alternate purlin clip and alternate lower support member attachment structure;

BEST MODE FOR CARRYING OUT THE INVENTION

Figure 1:
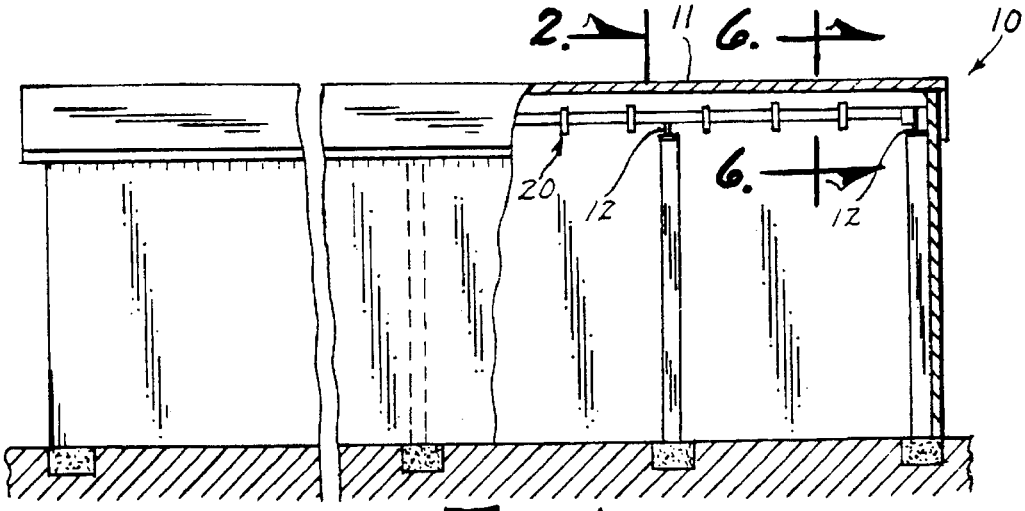
FIG. 1 is a side elevational view of a building to be insulated, having a portion thereof broken away to show the beams and purlins inside.
Figure 4:
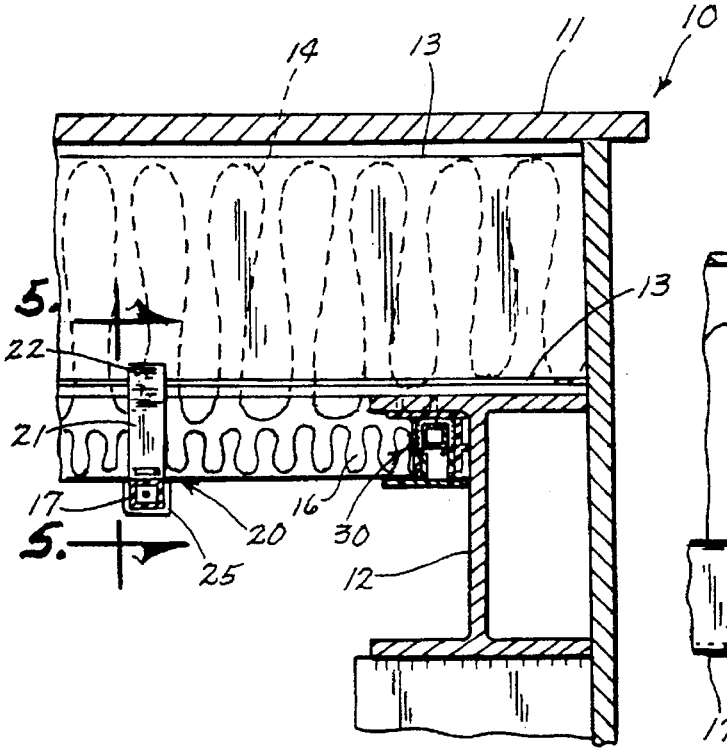
FIG. 4 is an enlarged cross sectional view taken along line 4—4 of FIG. 2 showing how the end I-beams support the purlins and how the insulation connector member purlin clips and support members are disposed after installation thereof.

Referring now to the drawings wherein like reference numerals designate identical or corresponding parts throughout the several views, FIG. 1 shows a building (10) having a roof (11) thereon of a type which can be insulated by the method and apparatus of the present invention. The building (10) includes structural beams (12) in FIGS. 1 and 4 for supporting purlins (13). These purlins (13) extend across the building from one beam (12) shown in FIG. 1 to another beam (12) which would be on the other end of the building, but covered up by the roof and sides of the building as shown in FIG. 1.

In order to install fiberglass insulation shown in FIG. 8 into the building (10), a fiberglass mat (14) of insulation is first positioned between adjacent purlins (13) and about every three feet as the fiberglass mat (14) is unrolled, the installer will insert a semi-rigid, flexible rod (15) between the purlins (13). This flexible rod (15) can preferably be made of fiberglass or metal of a type which will bend to hold itself in place between the purlins (13), but will return to a straight configuration when removed from between the purlins (13). This upper support member (15) is then utilized to hold the upper strip of insulation (14) in place until a lower strip of insulation (16) can be installed.

Purlin clips (20) shown in FIG. 9 can be hooked over the lip of each purlin (13) at predetermined intervals for the ultimate purpose of installing a lower support member (17).

Figure 3:
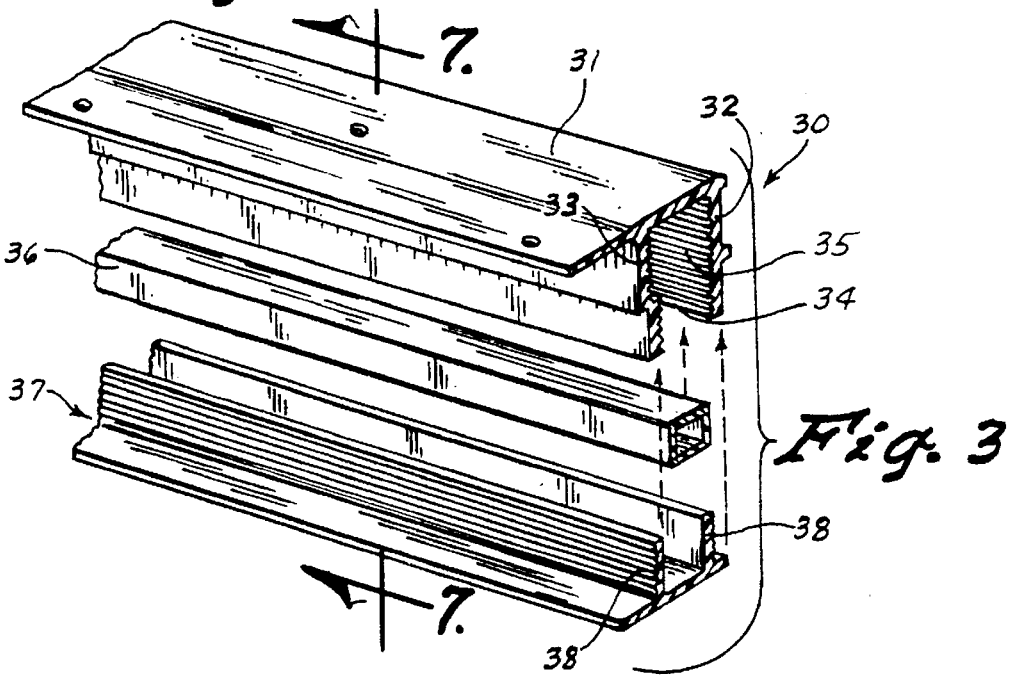
FIG. 3 is an exploded perspective view of a connecting apparatus for connecting the ends of the lower layer of insulation to the structural beams at each end of the building.
Figure 7:
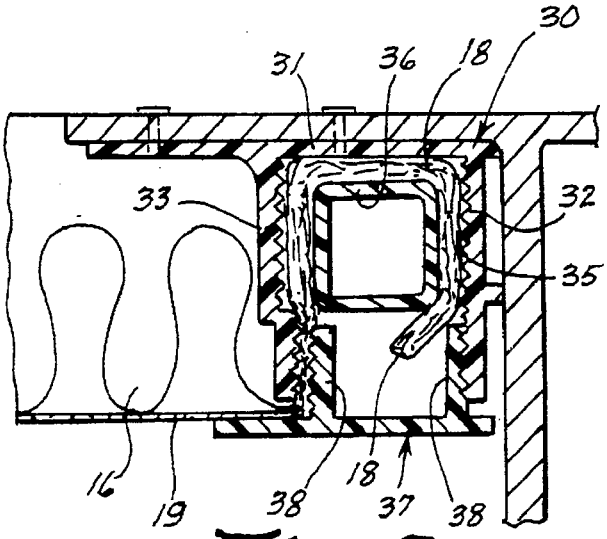
FIG. 7 is a cross sectional view taken along line 7—7 of FIG. 3 and also showing the structure connected to an I-beam and also in the position holding the end of the lower strip of insulation to the I-beam.

After the upper strip of insulation (14) is completely supported between adjacent purlins (13) as shown in FIG. 8, then the lower strip of insulation (16) is installed by first utilizing a connector (30) shown in FIGS. 3 and 7, for example. The connector (30) includes a base portion (31) having two spaced apart portions (32) and (33) forming a groove (34). The spaced apart portions (32) and (33) have longitudinal ridges (35) on the inside surface thereof and the portion (33) has a notched-out portion for receiving a support member (36) as can readily be seen in FIG. 7. If this notched-out portion (33) were not provided, then the holding member (36) would push the portions (32) and (33) apart instead of permitting the end (18) of the lower fiberglass mat (16) to extend around the holding member (36) and in the groove between leg portions (32) and (33).

The lower fiberglass mat (16) has a lower water impermeable facing (19) adhered thereto and this is all compressed into the groove (34) as shown in FIG. 7. Once the holding member (36) is installed to compress the end (18) of the insulation (16), a locking member (37) is pushed into the groove (34) as shown in FIG. 7 to lock the holding member (36) in place and provide an attractive trim for the end of the lower strip of insulation (16). This locking member (37) also has projecting portions (38) thereon and longitudinal projections on the outside thereof for cooperating with, and in some instances mating with, the longitudinal ridges and grooves inside of groove (34).

Referring to FIG. 8, it is noted that after the lower strip of insulation (16) is fully installed, the installer reaches up under the purlins and grasps the upper support members (15) and pulls them out under the purlin clips (13), to the right as shown in FIG. 8, and re-installs these upper support members (15) between the next adjacent pair of purlin clips, for example in the position of the dashed lines of upper support members (15) shown in FIG. 8. Then the upper strip of insulation (14) will fall down onto the lower strip of insulation, for example as in the far left part of FIG. 8. Then the process can continue by just continuing to install first the top layer (14) and then the bottom layer (16) of insulation between each and every adjacent pair of purlins (13).

Figure 5:
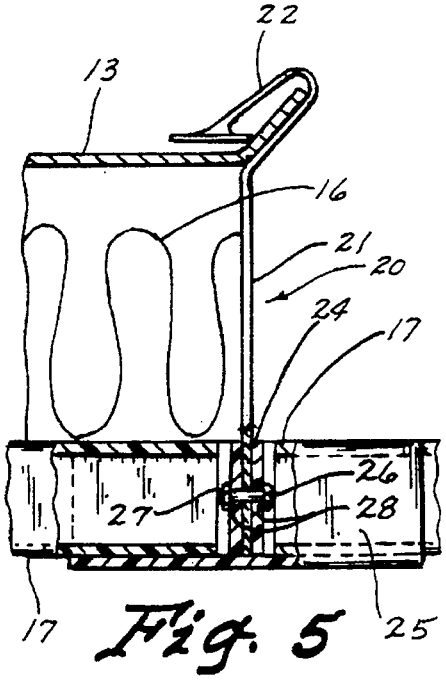
FIG. 5 is an enlarged cross sectional view taken along 5—5 of FIG. 4 showing the purlin clips and lower connector members for attaching the lower support members to hold the insulation in place.
Figure 6:
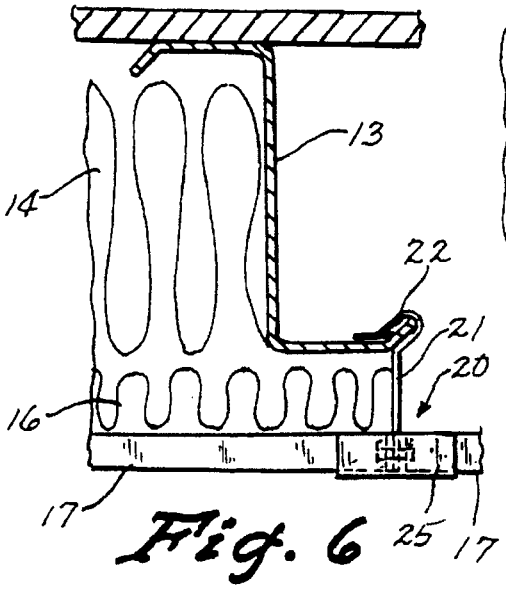
FIG. 6 is an enlarged cross sectional view taken along line 6—6 of FIG. 1.

Referring to FIG. 9, it is noted that purlin clip (20) includes a sheet metal portion (21) with a bend portion (22) on the top thereof for extending around a purlin as shown in FIG. 5. The lower portion of the purlin clip has a hole (23) therein and when the lower end of the clip (21) is received in an opening (24) in member (25), then a bolt (26) and nut (27) can be used to extend through and fasten the lower end of the purlin clip (21) because the bolt (26) extends through opening (28) and opening (23). Member (25) includes upwardly facing cavities (29) for receiving lower support members (17).

Alternatively, the purlin clip (21) with top (22) can be of the type shown in FIG. 10, having rectangular members (25*a*) attached thereto by a fastener (26*a*). Lower support member (17) merely telescope over the members (25*a*) rather than fitting into the cavity (29) as shown in FIG. 9.

Figure 11:
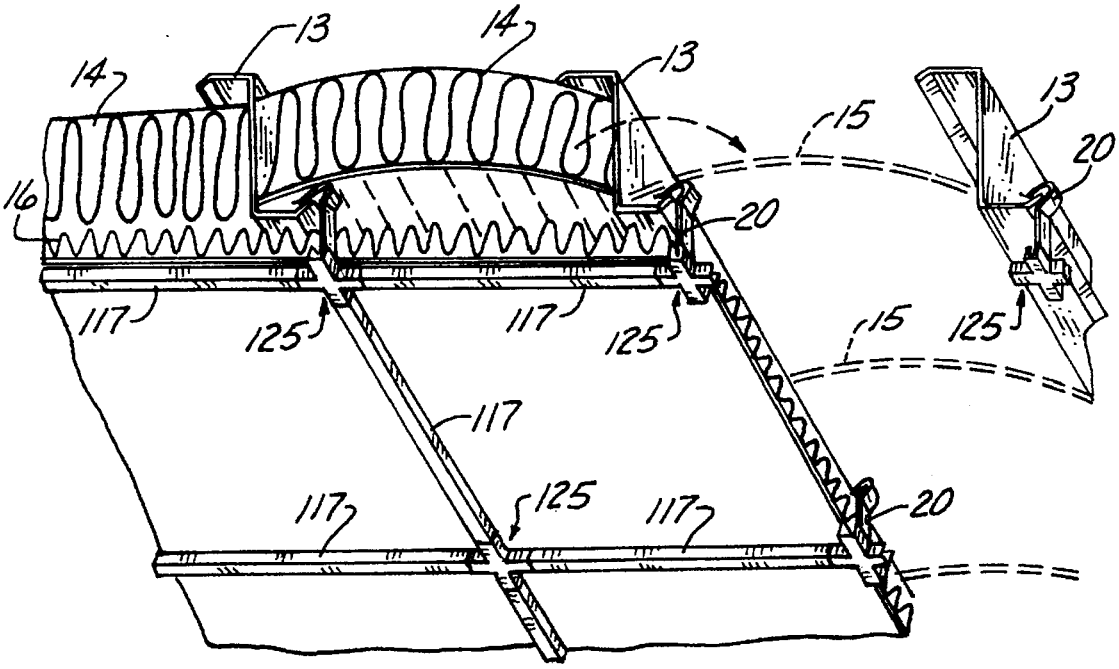
FIG. 11 shows a perspective view of an alternative arrangement for holding a lower support member to support the underside of the insulation.
Figure 12:
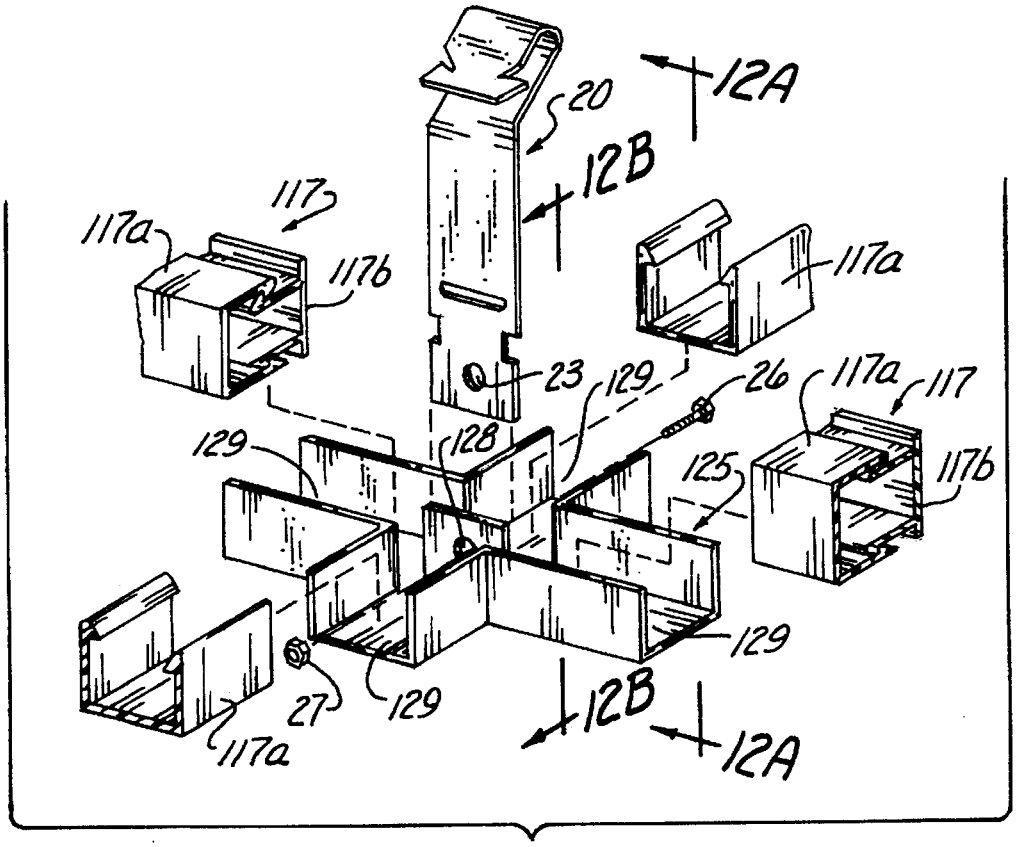
FIG. 12 is an exploded perspective view of a four-way lower support bracket.
Figure 13:
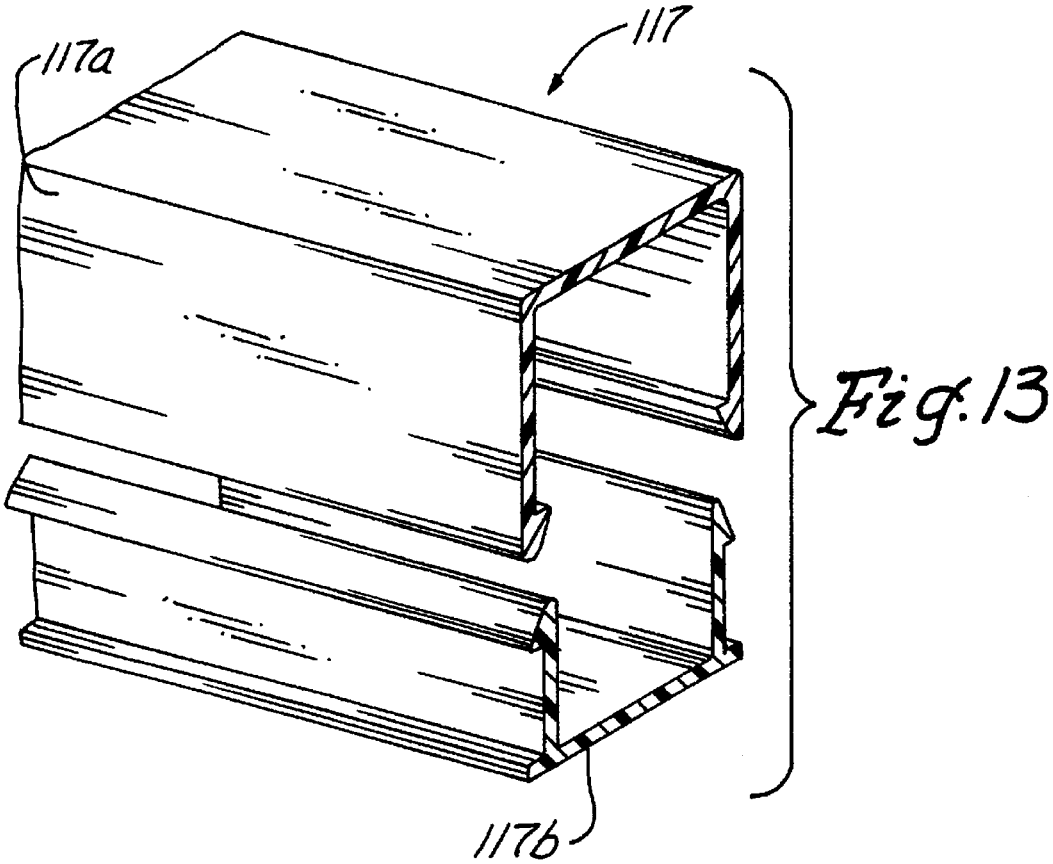
FIG. 13 shows an alternate, two-piece, lower support member in an exploded perspective view.

FIGS. 11–13 show a four-way bracket (125) held up by a purlin clip (20). Fasteners (26) and (27) hold bracket (125) up by passing through opening (23) in clip (20) and through opening (128) in member (124). The ends of lower support members (117) fit into cavities (129) of bracket (125) just like lower support members (17) fit into cavities (29) in the FIG. 9 embodiment, except that members (117*a*) do not need a cap when used in the direction shown in FIG. 12 because the top thereof merely supports the underside of vinyl strip (116).

Figure 12A:
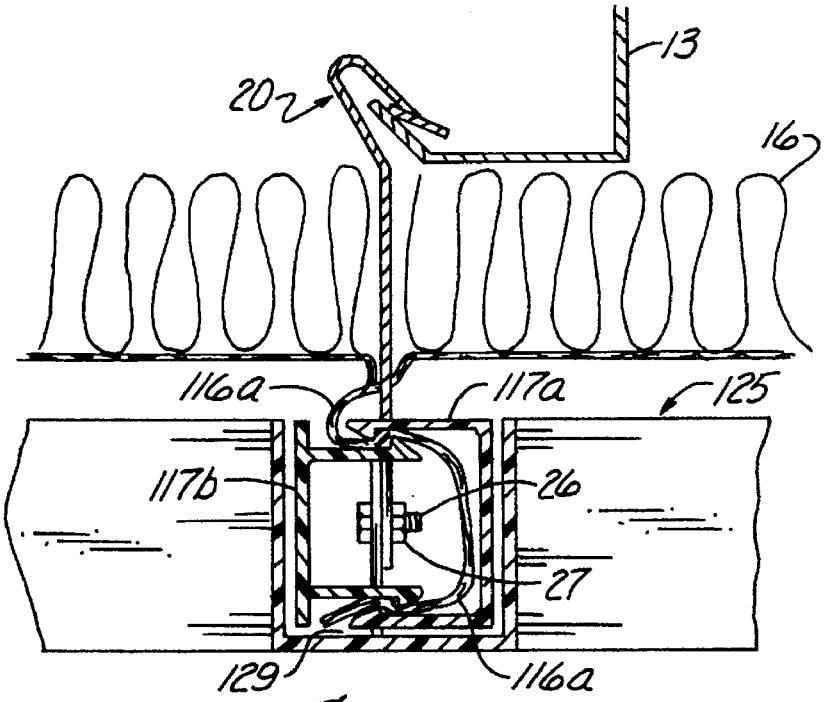
FIG. 12A is an enlarged cross-sectional view taken along line 12A—12A of FIG. 12.
Figure 12B:
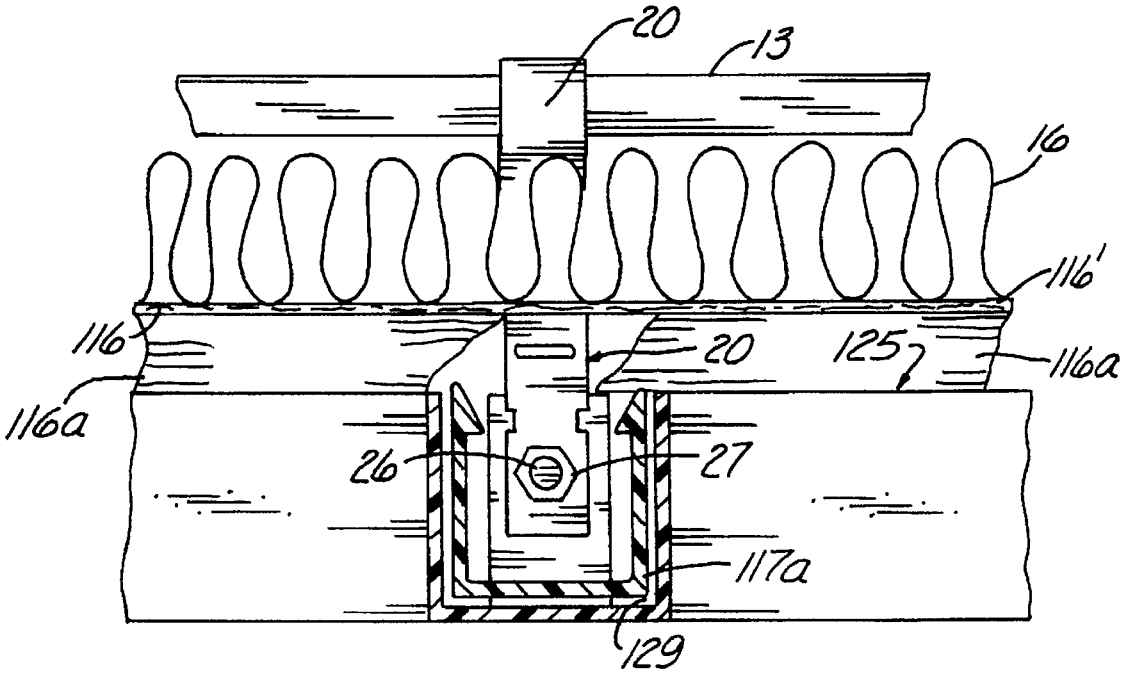
FIG. 12B is an enlarged cross-sectional line taken along line 12B—12B of FIG. 12.

FIGS. 12A and 12B show a space between vinyl strip (116) and the top of bracket (125) and the top of members (117*a*) and (117*b*), but this is merely done to clearly show the parts and how they fit together. In actual practice, the parts may start out in the positions shown in FIGS. 12A and 12B, but vinyl strip (116) ultimately settles down to rest on the top of bracket (125), and support members (117*a*) and (117*b*) from the position shown in FIGS. 12A and 12B.

Figure 14:
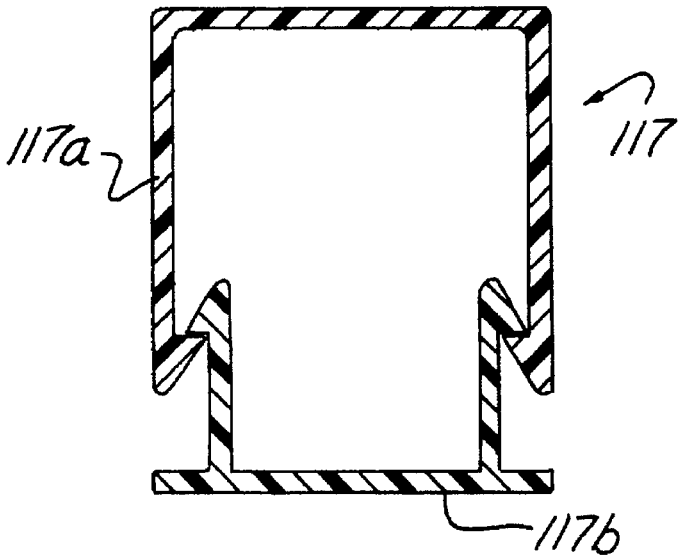
FIG. 14 is a cross-sectional view of the two-piece lower support member of FIG. 13.

FIGS. 13 and 14 show how part (117*a*) receives an interlocking cap (117*b*) to form the two-piece lower support member (117) and capture edges (116*a*) of vinyl strip (116) to provide a support and seal.

In operation, an upper support member (15) is installed between purlins (13). Then the strip of insulation (14) is installed as indicated above by unrolling it, for example by using as a roll of matted fiberglass insulation. An upper support member (15) can be put in place just before the insulation (14) is rolled over that portion of the structure or several support members (15) can be installed before the fiberglass strip (14) is unrolled. The structural members (15) are continuously placed ahead of the unrolled fiberglass (14), perhaps every three foot or so between adjacent purlins (13).

Figure 2:
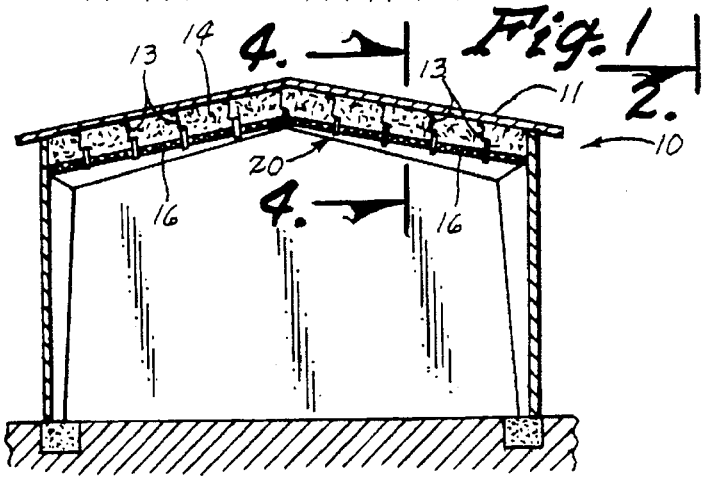
FIG. 2 is a cross sectional view taken along line 2—2 of FIG. 1 showing building fully insulated.

Once the entire strip of insulation (14) goes in from one side of the building (10) to the other, between adjacent purlins (13), the lower strip of insulation (16) with vinyl vapor barrier (116) attached thereto is installed by first attaching one end of the lower strip of fiberglass insulation (16) into the connector members (30) or the like as shown in FIG. 7, for example. Then the lower strip (16) is unrolled and is supported upwardly by placing lower support members (117) between adjacent purlin clips (20) as shown in FIGS. 8 and 11, until the entire lower layer of insulation (16) has been installed from one end of the building to the other. Of course this can be done either lengthwise of the building or across the building if desired. In this case, it is done lengthwise of the building, because of the configuration of the building (10) shown in FIGS. 1 and 2.

After the lower strip of insulation (16) extends entirely across the building, then the other end of the strip of insulation (16) would be securely held in place by a structure which is essentially a mirror image of that shown in FIG. 7 by utilizing the connector members (30) or the like as shown in FIG. 3.

Referring to FIG. 11, the underside of insulation (16) is supported by clips (20) from purlins (13) which hold support members (125), which in turn hold lower support members (117*a*) and (117*b*) to form a holding grid under the insulation (16). The seams (116*a*) between strips of fiberglass (16) are clipped together between members (117*a*) and (117*b*) of FIGS. 13 and 14 in the manner shown in FIG. 12A. A portion of seam (116*a*) has been broken away in FIG. 12B to show the relative placement of clip (20).

Accordingly, it will be appreciated that the method and apparatus shown and described has indeed accomplished the aforementioned objects. Obviously, many modifications and variations of the present invention are possible in light of the above teachings. It is therefore to be understood that, within the scope of the appended claims, the invention may be practiced otherwise than as specifically described.

I claim:

1. Apparatus for suspending a strip of insulation from purlins in a building, comprising:

a clip;

an a strip of insulation attachment structure on the top of said clip for attachment to a purlin;

a holding structure removably attached to the bottom of said clip, the holding structure having a plurality of upwardly facing channels and a plurality of elongated members for being received within the channels; and one end of one of said members being disposed in the holding structure and below said strip of insulation for holding the underside of said strip of insulation.

2. The apparatus of claim 1 wherein said holding structure comprises an upwardly facing cavity for receiving said one end of said elongated member.

3. The apparatus of claim 1 including a second holding structure attached to the bottom of said clip for holding one end of another elongated member.

4. The apparatus of claim 3 wherein said second holding structure is substantially a mirror image of the first said holding structure.

5. The apparatus of claim 4 including two more holding structures for receiving the ends of two more elongated members.

6. The apparatus of claim 1 wherein said elongated member comprises two interlocking pieces for clamping together adjacent edges of strips of insulation.

* * * * *